US007070896B2

(12) United States Patent
Kishimoto et al.

(10) Patent No.: US 7,070,896 B2
(45) Date of Patent: Jul. 4, 2006

(54) TONER AND PROCESS FOR PRODUCING TONER

(75) Inventors: Takuji Kishimoto, Kawasaki (JP); Rieko Takahara, Kawasaki (JP)

(73) Assignee: Zeon Corporation, Tokyo (JP)

( * ) Notice: Subject to any disclaimer, the term of this patent is extended or adjusted under 35 U.S.C. 154(b) by 97 days.

(21) Appl. No.: 10/471,752

(22) PCT Filed: Mar. 22, 2002

(86) PCT No.: PCT/JP02/02785

§ 371 (c)(1),
(2), (4) Date: Sep. 25, 2003

(87) PCT Pub. No.: WO02/077717

PCT Pub. Date: Oct. 3, 2002

(65) Prior Publication Data

US 2004/0072089 A1 Apr. 15, 2004

(30) Foreign Application Priority Data

Mar. 26, 2001 (JP) ..... 2001-087394

(51) Int. Cl.
*G03G 9/00* (2006.01)

(52) U.S. Cl. ..... 430/108.2; 430/108.21; 430/108.4; 430/108.5; 430/110.2; 430/137.15; 430/137.17

(58) Field of Classification Search ..... 430/108.2, 430/108.21, 108.4, 108.5, 110.2, 137.15, 430/137.17
See application file for complete search history.

(56) References Cited

U.S. PATENT DOCUMENTS 5,393,633 A * 2/1995 Furukawa et al. ..... 430/114
5,620,824 A * 4/1997 Okado et al. ..... 430/108.6
2002/0064404 A1* 5/2002 Iwai ..... 399/309

FOREIGN PATENT DOCUMENTS

| | | |
|---|---|---|
| JP | A 63-60458 | 3/1988 |
| JP | A 01-217464 | 8/1989 |
| JP | A 03-15858 | 1/1991 |
| JP | A 03-175456 | 7/1991 |
| JP | A 03-243954 | 10/1991 |
| JP | 05-019662 | 1/1993 |
| JP | 07-020652 | 1/1995 |
| JP | 07-209908 | 8/1995 |
| JP | 10-221883 | 8/1998 |
| JP | 10-333353 | 12/1998 |
| JP | 10-333358 | 12/1998 |
| JP | A 11-15192 | 1/1999 |
| JP | 11-038676 | 2/1999 |
| JP | 11-305487 | 11/1999 |
| JP | A 11-315106 | 11/1999 |
| JP | 2000-019768 | 1/2000 |
| JP | 2000-056508 | 2/2000 |
| JP | A 2001-42571 | 2/2001 |
| JP | 2002-144694 | 5/2002 |

* cited by examiner

*Primary Examiner*—Mark A. Chapman
(74) *Attorney, Agent, or Firm*—Armstrong, Kratz, Quintos, Hanson & Brooks, LLP

(57) ABSTRACT

A toner containing a binder resin, a colorant, a charge control agent, and a thiazolyl disulfide compound or a thiuram disulfide compound. A process for producing a toner comprising polymerization of a polymerizable monomer composition that contains a polymerizable monomer and a colorant in an aqueous medium in the presence of a compound selected from a group consisting of (1) a thiazol thio compound, (2) a thiuram compound and (3) a dithiocarbamate compound.

12 Claims, No Drawings

TONER AND PROCESS FOR PRODUCING TONER

TECHNICAL FIELD

The present invention relates to a toner and a production process thereof, and more specifically to a toner for developing an electrostatic latent image formed by an electrophotographic process, electrostatic recording process or the like, and a production process thereof.

BACKGROUND ART

In an image forming apparatus such as an electrophotographic apparatus or electrostatic recording apparatus, an electrostatic latent image formed on a photosensitive material is developed by a toner. Then, after the formed toner image is transferred to a transfer medium such as paper as required, the toner image is fixed by various methods such as heating, pressing and solvent-vapor treatment.

As the toner used in such an image forming apparatus as a developer, a toner produced by a pulverizing process, wherein a colorant, a charge control agent, a parting agent and the like are melted and mixed into a thermoplastic resin, which becomes a binder resin component, and dispersed evenly to form a composition, which is then pulverized and classified to obtain colored particles; a toner produced by suspension polymerization, wherein a colorant, a charge control agent, a parting agent and the like are dissolved or dispersed in a polymerizable monomer, which is a material for a binder resin, the monomer is suspended in an aqueous dispersing medium containing a dispersion stabilizer, heated to a predetermined temperature to initiate polymerization, filtered, washed, dehydrated and dried to obtain colored particles; or a toner produced by emulsion polymerization, wherein the particles of a binder resin containing polar groups are combined with particles containing a colorant and charge control agent are filtered, washed, dehydrated and dried to obtain colored particles; are used.

The fixing methods used in the image forming apparatus include pressing roller fixation, heating roller fixation, oven heating fixation, light radiation (flashing) fixation and solvent fixation. Among these, the fixing method using heating rollers wherein toner images on a transfer medium such as paper are passed between heating rollers is preferably used in view of the image quality or thermal efficiency. Although electric power is used for heating the rollers in the fixing method using heating rollers, the lowering of the fixing temperature is requested from the point of view of energy saving. From the aspect of toner design, this request is responded by lowering the melt viscosity of the binder resin.

To lower the melt viscosity of the binder resin obtained by ordinary radical polymerization, the molecular weight is decreased by the adjustment of the quantity of the initiator and the monomer ratio, or by the addition of a chain transfer agent, but the glass transition temperature of the binder resin is also lowered due to the occurrence of oligomers, resulting in a problem that the shelf stability is lowered.

In polymerization using aromatic vinyl compounds as the monomers, since the stop reaction occurs mainly by the two-molecule stop of the styrene radicals, a coupling reaction occurs. Therefore, when the molecular weight is measured, the molecular-weight distribution has a tailing in the high-molecular-weight side. The formation of high-molecular-weight bodies controlling the melt characteristics of the binder resin was not preferred especially for the resin for the color toner. Therefore, the lowering of the molecular weight of the binder resin is being devised.

As a method for controlling the occurrence of oligomers while reducing the molecular weight of the resin, living radical polymerization is being studied. Japanese Patent Application Laid-Open No. 11-315106 proposes a method for providing a polymer or a block polymer of a narrow molecular-weight distribution by polymerizing a polymerizable monomer using a radical initiator and a transition metal complex formed by the coordination of a specific ligand to the transition metal in an emulsion polymerization system.

However, according to examples, although polymers of a narrow molecular-weight distribution are surely formed, the polymerization conversion is as low as 60 to 90% even after 5 to 6 hours have elapsed, and a large quantity of monomers remain after polymerization. When this method is applied to the toner, the odor after fixation raises a problem. Especially when the toner is adopted as a color toner, the coloring properties demanded to the toner is impaired because transition metals are contained.

In the color toner, since the sharp melt properties of the resin is demanded, only a polyester-based copolymer has been used as the binder resin in the toner produced by the pulverizing method. Japanese Patent Application Laid-Open No. 2001-42571 discloses a toner that excels in fixing and charge properties using a polyester-based resin, a parting agent and a styrene acrylate-based resin containing a quaternary base. However, the pulverizing method that compounds large quantities of parting agent and low-molecular-weight wax, since the wax is unevenly distributed on the surfaces of the toner, the anti-filming and charge properties are affected causing problems.

DISCLOSURE OF THE INVENTION

It is an object of the present invention to provide a toner that excels in the balance of fixing properties and storage properties, and can form clear images; and a process for stably producing such a toner; especially applied to color toners, a toner that excels in sharp melt properties required for reproducing the clear color tone of color images; and a process for producing such a toner.

The present inventors have carried out extensive investigations with a view toward achieving the above-described object, and found that the above-described object can be achieved by allowing toner particles to contain a specific disulfide compound. The present invention has been led to completion on the basis of this finding.

Thus, according to the present invention, there is provided a toner containing a binder resin, a colorant, a charge control agent, and a benzothiazolyl disulfide compound or a thiuram disulfide compound.

Furthermore, according to the present invention, there is also provided a process for producing a toner comprising the polymerization of a polymerizable monomer composition that contains a polymerizable monomer and a colorant in an aqueous medium in the presence of compound A selected from a group consisting of (1) a thiazol thio compound, (2) a thiuram compound and (3) a dithiocarbamate compound.

BEST MODE FOR CARRYING OUT THE INVENTION

1. Toner

The toner of the present invention contains a binder resin, a colorant, a charge control agent, and a thiazolyl disulfide compound or a thiuram disulfide compound.

The examples of the binder resin include thermoplastic resins that have been used widely in toners, such as polystyrene, styrene-butyl acrylate copolymers, polyester resins and epoxy resins.

As the colorant, any pigment and/or dye, as well as carbon black, titanium black, magnetic powders, oil black, or titanium white can be employed. Carbon black of a black color of a primary particle diameter of 20 to 40 nm is preferably used. If the primary particle diameter is smaller than 20 nm, the carbon black may be agglomerated and dispersed unevenly in the toner, resulting in a high fog level. On the other hand, if the primary particle diameter is larger than 40 nm, a large quantity of multivalent aromatic hydrocarbon compounds such as benzpyrene formed during the production of carbon black may remain in the toner causing environmental safety problems.

For obtaining a full-color toner, a yellow colorant, a magenta colorant and a cyan colorant are normally used.

As yellow colorants, compounds such as azo pigments and condensed polycyclic pigments are used. Specific examples include C.I. Pigment Yellow 3, 12, 13, 14, 15, 17, 62, 65, 73, 83, 90, 93, 97, 120, 138, 155, 180 and 181.

As magenta colorants, compounds such as azo pigments and condensed polycyclic pigments are used. Specific examples include C.I. Pigment Red 48, 57, 58, 60, 63, 64, 68, 81, 83, 87, 88, 89, 90, 112, 114, 122, 123, 144, 146, 149, 163, 170, 184, 185, 187, 202, 206, 207, 209, 251, and C.I. Pigment Violet 19.

As cyan pigments, copper-phthalocyanine compounds and the derivatives thereof, and anthraquinone compounds can be used. Specific examples include C.I. Pigment Blue 2, 3, 6, 15, 15:1, 15:2, 15:3, 15:4, 16, 17 and 60.

The colorants are used in a proportion of 1 to 10 parts by weight to 100 parts by weight of the binder resin.

As the charge control agent, various charge control agents can be used. The examples of charge control agents include Bontron N-01 (product of Orient Chemical Industries Ltd.), Nigrosine Base EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-81 (product of Orient Chemical Industries Ltd.), Bontron E-84 (product of Orient Chemical Industries Ltd.), Bontron E-89 (product of Orient Chemical Industries Ltd.), Bontron F-21 (product of Orient Chemical Industries Ltd.), COPY CHRGE NEG (product of Clariant (Japan)K.K.), COPY CHRGE NEG (product of Clariant (Japan)K.K.), TNS-4-1 (product of Hodogaya Chemical Co., Ltd.), TNS-4-2 (product of Hodogaya Chemical Co., Ltd.) and LR-147 (product of Japan Carlit Co., Ltd.). In addition, copolymers containing quaternary ammonium (salt) groups according to the descriptions of Japanese Patent Application Laid-Open No. 63-60458, Japanese Patent Application Laid-Open No.3-175456, Japanese Patent Application Laid-Open No. 3-243954 and Japanese Patent Application Laid-Open No. 11-15192; or copolymers containing sulfonic acid (salt) groups according to the descriptions of Japanese Patent Application Laid-Open No. 1-217464 and Japanese Patent Application Laid-Open No. 3-15858 may be synthesized to use as a charge control agent (hereafter referred to as "charge control resin").

Among these charge control agents, charge control resins are preferably used. The charge control resins are preferable because they are highly miscible with the binder resin, are colorless, and can obtain a toner of stable charge properties even in high-speed continuous color printing.

The glass transition temperature of a charge control resin is normally 40 to 80° C., preferably 45 to 75° C., and more preferably 45 to 70° C. If it is lower than these rages, the shelf stability of the toner may be worsened, while if it is higher than these rages, the fixing properties may be lowered.

The charge control agent is used in a proportion of generally 0.01 to 20 parts by weight, preferably 0.1 to 10 parts by weight per 100 parts by weight of the binder resin.

Thiazolyl disulfide compounds referred in the present invention are compounds that have a structure wherein S—S is directly bonded to the 2-position of a thiazolyl group, and the examples include dibenzothiazyl disulfide, 2-(4'-morpholinodithio) benzothiazole, 1,1'-bis(2-benzothiazolylthio) methane, and 1,2'-bis(2-benzothiazolylthio) ethane.

Thiuram disulfide compounds are compounds that have a structure wherein S—S is directly bonded to the carbon atom of a thiuram group, and the examples include tetramethyl thiuram disulfide, tetraethyl thiuram disulfide, tetrabutyl-thiuram disulfide, dipentamethylene thiuram tetrasulfide, N,N'-dimethyl-N,N'-diphenyl thiuram disulfide, and N,N'-dioctadecyl-N,N'-diisopropyl thiuram disulfide.

The content of the thiazolyl disulfide compound or the thiuram disulfide compound is generally 10 to 5,000 ppm, preferably 10 to 500 ppm, and more preferably 10 to 100 ppm. If the content is small, charge stability may be lowered, and if the content is excessively large, odor derived from sulfur compounds occurs not preferably. These contents can be determined using a mass spectrometer, liquid chromatography, gas chromatography, $^{1}$H-NMR, $^{13}$C-NMR and an infrared spectrophotometer.

Although methods for allowing the toner to contain a thiazolyl disulfide compound or a thiuram disulfide compound include (i) polymerization in the presence of these compounds, or in the presence of a compound inverted to these compounds, (ii) the addition of these compounds during melting and kneading, and (iii) the post addition of these compounds to the toner after drying, (i) polymerization in the presence of these compounds, or in the presence of a compound inverted to these compounds is preferable.

The toner of the present invention may contain a parting agent, a magnetic material or the like.

Examples of parting agents include polyolefin waxes, such as low molecular weight polyethylene, low molecular weight polypropylene and low molecular weight polybutylene; natural vegetable waxes, such as candelilla, carnauba, rice, Japan tallow and jojoba; petroleum waxes and modified waxes thereof, such as paraffin, microcrystalline and petrolactam; synthetic waxes, such as Fischer-Tropsch wax; and multifunctional ester compounds, such as pentaerythritol tetramyristate, pentaerythritol tetrapalmitate and dipentaerythritol hexamyristate.

These can be used alone, or in combination of two or more.

Among these, synthetic waxes, petroleum waxes, multifunctional ester compounds and the like are preferable. Among the multifunctional ester compounds, multifunctional ester compounds such as pentaerythritol esters, whose heat absorption peak temperature during ascending temperature in the DSC curve determined using a differential scanning calorimeter is within a range between 30° C. and 200° C., preferably between 40° C. and 160° C., and more preferably between 50° C. and 120° C.; or dipentaerythritol esters, whose heat absorption peak temperature is within a range between 50° C. and 80° C., are especially preferred in view of fixing-parting balance as a toner. Among them, esters that have a molecular weight of 1,000 or more, dissolve in styrene in the proportion of 5 parts by weight per 100 parts by weight of styrene at 25° C., and have an acid value of 10 mgKOH/g or less are further preferred because they exert significant effects for lowering fixing temperatures. The heat absorption peak temperature is the value measured in accordance with ASTM D3418-82.

The parting agent is used in a proportion of generally 0.5 to 50 parts by weight, preferably 1 to 20 parts by weight per 100 parts by weight of the binder resin.

Examples of magnetic materials include ion oxides such as magnetite, γ-iron oxide, ferrite, iron-excess ferrite; metals such as iron, cobalt and nickel, or alloys of these metals with metals such as aluminum, cobalt, copper, lead, magnesium, tin, zinc, antimony, beryllium, bismuth, cadmium, calcium, manganese, selenium, titanium, tangsten and vanadium, and the mixtures thereof.

Although the volume average particle diameter (dv) of the toner of the present invention is not limited to a specific value, it is generally 2to 10 μm, preferably 2to 9 μm, and more preferably 3 to 8 μm. Although the volume average particle diameter (dv)/number average particle diameter (dp) is not also limited to a specific value, it is generally 1.7 or less, preferably 1.5 or less, and more preferably 1.3 or less.

The softening point (hereafter may be referred to as "Ts") measured using a flow tester is generally 55 to 70° C., the flow-beginning temperature (hereafter may be referred to as "Tfb") is generally 75 to 130° C., and the glass transition temperature measured using a differential scanning calorimeter (hereafter may be referred to as "DSC") is generally 0 to 80° C., preferably 40 to 60° C.

The toner of the present invention can be obtained by combining two different polymers in the inner portion of a particle (core layer) and the outer portion (shell layer), and can be the particles of a core-shell structure (also referred to as a capsule type). The toner of a core-shell structure is preferred, because lowering of fixing temperatures and the prevention of aggregation in storage are well balanced by enclosing the low softening point substance of the inner portion with a substance having a higher softening point. Methods for obtaining the toner of a core-shell structure include spray drying, boundary reaction, in-situ polymerization and phase separation. In-situ polymerization and phase separation are particularly preferred because of their high production efficiency. In this time, the core particles of the toner of a core-shell structure may be obtained by pulverizing, polymerization, association, or phase-inversion emulsification.

In the case of the toner of a core-shell structure, although the volume average particle diameter is not limited to a specific value, it is generally 2 to 10 μm, preferably 2 to 9 μm, and more preferably 3 to 8 μm. Although the volume average particle diameter (dv)/number average particle diameter (dp) is not also limited to a specific value, it is generally 1.7 or less, preferably 1.5 or less, and more preferably 1.3 or less.

Although the weight ratio of the core layer and the shell layer in the toner of a core-shell structure is not limited to a specific value, it is generally 80/20 to 99.9/0.1.

If the proportion of the shell layer is smaller than the above-described proportion, the shelf stability may be worsened, and if it is larger than the above-described proportion, fixing at low temperature may become difficult.

The average thickness of the shell layer of the toner of a core-shell structure is generally 0.001 to 1.0 μm, preferably 0.003 to 0.5 μm, and more preferably 0.005 to 0.2 μm. If the thickness is large, fixing properties may be lowered, and if it is small, the shelf stability may be worsened. The entire surfaces of the core particles that form the toner of a core-shell structure are not necessarily covered with the shell layer.

When the diameter of core particles and the thickness of the shell layer of the toner of a core-shell structure can be observed using an electron microscope, the dimensions of the particles and the thickness of the shell randomly selected from the observed photograph can be directly measured; and when it is difficult to observe the core layer and the shell layer, the diameter of core particles and the thickness of the shell layer can be calculated from the particle diameter of the core particles and the quantity of the monomer that forms the shell layer used when the colored particles are produced.

Furthermore, the toner particles can be subjected to external-additive treatment. Specifically, by bonding or burying an additive (hereafter referred to as external additive) on the surface of the particles, the charge properties, flow properties or shelf stability of the particles can be adjusted.

Examples of external additives include inorganic particles, the particles of organic acid salts and the particles of organic resins. The inorganic particles include silica, aluminum oxide, titanium oxide, zinc oxide, tin oxide, barium titanate and strontium titanate.

The surfaces of these inorganic particles can be subjected to hydrophobic treatment, and the hydrophobic-treated silica particles are particularly preferred. In hydrophobic-treatment, the hydrophobicity determined by a methanol method is generally 30 to 90%, and preferably 40 to 80%. If the hydrophobicity is low, the effect of environment increases, and fog may easily occur especially under high-temperature, high-humidity conditions.

Examples of the particles of organic acid salts include zinc stearate and calcium stearate.

Examples of the particles of organic resins include the particles of methacrylate ester polymer, the particles of acrylate ester polymer, the particles of styrene-methacrylate ester copolymer and the particles of a core-shell structure whose core is formed by styrene polymer and whose shell is formed by methacrylate ester polymer. Among these, inorganic particles, especially silica particles are preferred.

Although the quantity of external additives is not limited to a specific value, it is generally 0.1 to 6 parts by weight per 100 parts of toner particles. Two or more external additives can be used in combination. When the external additives are used in combination, the combination of the same inorganic particles of different average particle diameters, or the combination of inorganic particles and organic particles is preferred. In order to bond external additives to above-described polymer particles, generally, external additives and colored polymer particles are charged and mixed in a mixer such as a Henschell mixer.

2. Production Process of the Toner

In a process for producing a toner according to the present invention, a polymerizable monomer composition that contains a polymerizable monomer and a colorant in an aqueous medium are polymerized in the presence of compound A selected from a group consisting of (1) a thiazol thio compound, (2) a thiuram compound and (3) a dithiocarbamate compound.

In the preferable process for producing a toner according to the present invention, a colorant and compound A selected from a group consisting of (1) a thiazol thio compound, (2) a thiuram compound and (3) a dithiocarbamate compound are dissolved or dispersed in a polymerizable monomer composition to obtain a polymerizable monomer composition; and the polymerizable monomer composition is dispersed in an aqueous dispersion medium containing a dispersion stabilizer, heated to a predetermined temperature to initiate polymerization, and after the completion of polymerization, the resultant toner is filtered, washed, dehydrated and dried.

A charge control agent and a parting agent can be contained in the polymerizable monomer composition.

A thiazole thio compound in the present invention is a compound wherein sulfur is bonded to the 2-position of thiazol, and examples of the thiazole thio compounds include 2-mercaptobenzothiazol, dibenzothiazyl disulfide, 2-mercaptobenzothiazol zinc salt, 2-mercaptobenzothiazol sodium salt, 2-mercaptobenzothiazol cyclohexylamine salt, 2-(4'-morpholinothio) benzothiazole, 1,1'-bis (2-benzothazolyl dithio) methane, 1,2'-bis (2-benzothazolyl dithio) ethane, N-cyclohexyl-2-benzothazolyl sulfenamide, N-oxydiethylene-2-benzothiazolyl sulfenamide and N-t-butyl-2-benzothiazolyl sulfenamide.

A thiuram compound is a compound wherein sulfur is bonded to the carbon atom of a thiuram group, and examples of the thiuram compounds include tetramethylthiuram monosulfide, tetramethylthiuram disulfide, tetraethylthiuram disulfide, tetrabutylthiuram disulfide and dipentamethylenethiuram tetrasulfide.

Examples of the dithiocarbamate compound include pentamethylenedithiocarbamate piperidine salt, pipecolyldithiocarbamate pipecoline salt, sodium dimethyldithio carbamate, sodium diethyldithio carbamate, sodium dibutyldithio carbamate, zinc dimethyldithio carbamate, zinc diethyldithio carbamate, zinc dibutyldithio carbamate, zinc N-ethyl-N-phenyldithio carbamate and tellurium diethyldithio carbamate.

These compounds A can be used alone, or in combination of two or more.

The toner obtained by using a thiazole thio compound or a thiuram compound, particularly a benzothiazolyl disulfide compound or a thiuram disulfide compound among these is preferred since they have a high effect on improving the melting behavior (e.g., sharpness of melting) thereof.

Generally, although a polymerization initiator is used on starting polymerization, in the production process according to the present invention, wherein polymerization is performed in the presence of compound A selected from a group consisting of (1) a thiazol thio compound, (2) a thiuram compound and (3) a dithiocarbamate compound, since the compound A can act as the polymerization initiator when light or electron beams are used, the polymerization can be initiated without using generally used polymerization initiator.

The compound A is generally used at 0.01 to 10 parts by weight, preferably 0.1 to 5 parts by weight, more preferably 0.5 to 3 parts by weight, and most preferably 0.7 to 2.5 parts by weight per 100 parts by weight of the polymerizable monomer. If the added quantity is small, the improving effect of the sharp melt properties of the toner cannot be obtained; on the other hand, when the added quantity is excessively large, defects such as the lowering of the polymerization rate and the incomplete polymerization occur.

Although the compound A can be added after polymerization is initiated, it is preferable for effective action that the compound A is added in the polymerizable monomer composition before the initiation of the polymerization.

The method for polymerization is not specifically limited, but known suspension polymerization, emulsion polymerization, dispersion polymerization and the like can be applied.

Among these, suspension polymerization wherein no emulsifier, which affects the control of charge properties, is used, colorants, a parting agent and the like are incorporated in particles, and a desired particle diameter can be obtained in one stage, is preferred.

The process for producing a toner will be described below referring to the suspension polymerization as an example.

As a polymerizable monomer, a monovinyl monomer can be used. Specific examples include a romatic vinyl monomer such as styrene, vinyl toluene and α-methyl styrene; (meth) acrylic acid; the derivatives of (meth) acrylic acid such as methyl (meth) acrylate, ethyl (meth) acrylate, propyl (meth) acrylate, butyl (meth) acrylate, 2-ethylhexyl (meth) acrylate, cyclohexyl (meth) acrylate, isobonyl (meth) acrylate, dimethylaminoethyl (meth) acrylate and (meth) acryl amide; and monoolefin monomer such as ethylene, propylene and butylene.

Monovinyl monomers can be used alone, or in combination of a plurality of monomers. Among these monovinyl monomers, an aromatic vinyl monomer alone, the combination of an aromatic vinyl monomer and a derivative of (meth) acrylic acid are preferably used.

The use of a cross-linkable compound, such as a cross-linkable monomer and a cross-linkable polymer is effective for the improvement of hot offset.

The cross-linkable monomer is a monomer that has two or more polymerizable carbon-carbon unsaturated double bonds. Specific examples of cross-linkable monomers include aromatic divinyl compounds such as divinyl benzene, divinyl naphthalene, and the derivatives thereof; diethylenic unsaturated carbonic esters such as ethyleneglycol methacrylate and diethyleneglycol methacrylate; other divinyl compounds having two vinyl groups such as N,N'-divinyl aniline and divinyl ether; and compounds having three or more vinyl groups such as pentaerythritol triallyl ethers and trimethylolpropane triacrylate.

The cross-linkable polymer is a polymer that has two or more vinyl groups in the polymer, and specific examples of cross-linkable polymers include the ester of a polymer that has two or more hydroxyl groups in the molecule thereof (hydroxyl-group-containing polyethylene, hydroxyl-group-containing polypropylene, polyethylene glycol, polypropylene glycol and the like) with an ethylenic unsaturated carboxylic acid (acrylic acid, methacrylic acid and the like)

These cross-linkable monomers and cross-linkable polymers may be used alone, or in combination of two or more. The quantity used is generally 10 parts by weight or less, preferably 0.1 to 2 parts by weight per 100 parts by weight of the polymerizable monomer.

The use of a macromonomer together with the polymerizable monomer is also preferred because the balance of shelf stability and fixing-properties at low temperatures is improved. A macromonomer is an oligomer or a polymer having a vinyl-polymerizable functional group at the end of the molecular chain thereof, and having a number average molecular weight of generally 1,000 to 30,000. If the macromonomer having a small number average molecular weight is used, the surface portions of the polymer particles are softened and shelf stability is lowered. On the other hand, if the macromonomer having a large number average molecular weight is used, the macromonomer becomes difficult to melt, and the fixing properties and shelf stability are lowered.

Examples of vinyl-polymerizable functional groups at the end of the molecular chain of the macromonomer include an acryloyl group, a methacryloyl group and the like; and the methacryloyl group is preferred in view of the ease of copolymerization.

It is preferable that the macromonomer has a glass transition temperature higher than the glass transition temperature of a polymer obtained by polymerizing the monovinyl monomers.

Specific examples of the macromonomers used in the present invention include polymers obtained by polymerizing one or more styrene, styrene derivatives, methacrylic esters, acrylic esters, acrylonitrile, methacrylonitrile or the like; and macromonomers having polysiloxane skeletons; among which hydrophilic polymers, especially, polymers obtained by polymerizing methacrylic esters or acrylic esters alone or in combination are preferred.

When a macromonomer is used, the quantity is generally 0.01 to 10 parts by weight, preferably 0.03 to 5 parts by weight, and more preferably 0.05 to 1 part by weight per 100 parts by weight of the polymerizable monomer. If the quantity of the macromonomer is small, the shelf stability will not be improved. If the quantity of the macromonomer is extremely large, the fixing properties will be lowered.

In order to perform polymerization stably, a dispersion stabilizer can be added to the reaction liquid. Examples of dispersion stabilizers include metal compounds, such as sulfates such as barium sulfate and calcium sulfate; carbonates such as barium carbonate, calcium carbonate and magnesium carbonate; phosphates such as calcium phosphate, metal oxides such as aluminum oxide and titanium oxide; metal hydroxides such as aluminum hydroxide, magnesium hydroxide and iron (III) hydroxide; water-soluble polymers such as polyvinyl alcohol, methylcellulose and gelatin; and anionic surface active agents, nonionic surface active agents and ampholytic surface active agents. Among these, dispersion stabilizers containing metal compounds, especially containing the colloid of a metal hydroxide hardly soluble in water are preferred, because they can narrow the particle-diameter distribution of the polymer particles, the dispersion stabilizer little remains after washing, and the images are little affected.

Although there is no limitation in the production process of the dispersion stabilizer that contains the colloid of a metal hydroxide hardly soluble in water, it is preferred to use the colloid of a metal hydroxide hardly soluble in water obtained by adjusting the pH of the aqueous solution of a water-soluble multivalent metal compound to 7 or more; especially, the colloid of a metal hydroxide hardly soluble in water formed by the reaction of a water-soluble multivalent metal compound with an alkali-metal hydroxide in a water phase.

The proportion of the use of the water-soluble multivalent metal compound and the alkali-metal hydroxide is that the ratio A of the chemical equivalent of the alkali-metal hydroxide to the chemical equivalent of the water-soluble multivalent metal compound is within the range of $0.4 \leqq A \leqq 1.0$.

It is preferred that the colloid of the metal hydroxide hardly soluble in water has a number particle-size distribution D50 (the 50% cumulative value of the number particle-size distribution) is 0.5 μm or less, and D 90 (the 90% cumulative value of the number particle-size distribution) is 1 μm or less. If the particle diameter of the colloid is large, the stability of polymerization will be lost, and the shelf stability of the toner will be lowered.

The dispersion stabilizer is used in the proportion of generally 0.1 to 20 parts by weight per 100 parts by weight of the polymerizable monomer. If the proportion is excessively low, the aggregate of the polymer particles will be formed easily; on the other hand, if the proportion is excessively high, the distribution of the particle diameters of the toner is widened, and the yield will be lowered by classification.

Although polymerization can be initiated by the compound A in the production process of the present invention, it is preferred to use other polymerization initiators in combination. Examples of polymerization initiators include persulfates such as potassium persulfate and ammonium persulfate; azo compounds such as 4,4'-azobis (4-cyanovaleric acid), 2,2'-azobis (2-amidinopropane) dihydrochloride, 2,2'-azobis-2-methyl-N-1,1'-bis (hydroxymethyl)-2-hydroxyethyl propioamide, 2,2'-azobis (2,4-dimethylvaleronitrile), 2,2'-azobis isobutylonitrile and 1,1'-azobis (1-cyclohexane carbonitrile); and peroxides such as methylethyl peroxide, di-t-butyl peroxide, acetyl peroxide, dicumyl peroxide, lauroyl peroxide, benzoyl peroxide, t-butyl peroxy-2-ethyl hexanoate, t-butyl perbutyl neodecanoate, t-hexyl peroxy-2-ethyl hexanoate, t-butyl peroxy pivalate, t-hexyl peroxy pivalate, di-isopropyl peroxy dicarbonate, di-t-butyl peroxy isophthalate, 1,1',3,3'-tetramethylbutyl peroxy-2-ethyl hexanoate and t-butyl peroxy isobutylate. The examples also include redox initiators formed by combining these polymerization initiators and a reducing agent.

Among these, it is particularly preferable to select an oil-soluble polymerization initiator that is soluble in the polymerizable monomer to be used, and a water-soluble polymerization initiator can be used in combination as required. The polymerization initiator is used in proportion of 0.1 to 20 parts by weight, preferably 0.3 to 15 parts by weight, and more preferably 0.5 to 10 parts by weight per 100 parts by weight of the polymerizable monomer.

On polymerization, the addition of a molecular-weight adjusting agent is preferred. Examples of molecular-weight adjusting agents include mercaptans such as t-docecyl mercaptan, n-docecyl mercaptan, n-octyl mercaptan and 2,2,4,6,6-pentamethylheptane-4-thiol; and halogenized hydrocarbons such as carbon tetrachloride and carbon tetrabromide. These molecular-weight adjusting agents can be added before starting polymerization or during polymerization. The molecular-weight adjusting agent is used in the proportion of generally 0.01 to 10 parts by weight, preferably 0.1 to 5 parts by weight per 100 parts by weight of the polymerizable monomer.

As the process for producing the toner of a core-shell structure, methods such as spray drying, boundary reaction, in-situ polymerization and phase separation can be adopted. In particular, in-situ polymerization and phase separation are preferred in the aspect of production efficiency.

The process for producing the toner of a core-shell structure using in-situ polymerization will be described below.

Core particles are produced by suspending a polymerizable monomer composition (polymerizable monomer composition for the core) containing at least a polymerizable monomer (polymerizable monomer for the core), a colorant, a charge control agent and a compound selected from a group consisting of (1) a thiazol thio compound, (2) a thiuram compound and (3) a dithiocarbamate compound in an aqueous dispersion medium containing a dispersion stabilizer, and polymerizing using a polymerization initiator; and a toner of a core-shell structure is obtained by further adding a polymerizable monomer (polymerizable monomer for the shell) and a polymerization initiator, and polymerizing. The core particles can be obtained in the same manner as the toner obtained by the above-described suspension polymerization method.

Examples of polymerizable monomers for the core include the same compounds as described above. Among these, compounds that can form polymers, having a glass transition temperature of generally 60° C. or below, preferably 40 to 60° C. are preferred as monomers for the core. If the glass transition temperature is excessively high, the fixing temperature elevates; on the other hand, if the glass transition temperature is excessively low, shelf stability lowers. Generally, the monomer for the core is used alone, or often used in combination of two or more.

The monomer for the shell is added to the obtained core particles, and is polymerized again to form the shell layer of the toner of a core-shell structure.

Specific examples of method for forming the shell include a method wherein a polymerizable monomer for the shell is added to the reaction system of the above-described polymerization reaction performed for obtaining the core particles, and continuously polymerized; and a method wherein the core particles obtained in a separate reaction system is charged, and a polymerizable monomer for the shell is added thereto, and polymerized stepwise.

The polymerizable monomer for the shell may be added in the reaction system in a lump, or may be added continuously or intermittently using a pump such as a plunger pump.

The glass transition temperature of the polymer consisting of a polymerizable monomer for the shell must be set to be higher than the glass transition temperature of the polymer consisting of a polymerizable monomer for the core. In order to improve the shelf stability of the polymerized toner, the glass transition temperature of the polymer obtained from the polymerizable monomer for the shell is generally 50 to 130° C., preferably 60 to 120° C., and more preferably 80 to 110° C. If the glass transition temperature is lower than these ranges, shelf stability may be lowered; on the other hand, if the glass transition temperature is higher than these ranges, fixing properties may be lowered.

Difference in glass transition temperature between the polymer consisting of the polymerizable monomer for the core and the polymer consisting of the polymerizable monomer for the shell is generally 10° C. or more, preferably 20° C. or more, and more preferably 30° C. or more. If the difference is smaller, the balance of shelf stability and fixing properties may be lowered.

As the monomer constituting the polymerizable monomer for the shell, monomers that form polymers having a glass transition temperature exceeding 80° C., such as styrene, acrylonitrile and methyl methacrylate can be used alone, or in combination of two or more.

When the polymerizable monomer for the shell is added, the addition of a water-soluble radical initiator is preferred, because capsule toner can be easily obtained. This is considered because if the addition of a water-soluble radical initiator when the polymerizable monomer for the shell is added, the water-soluble radical initiator intrudes to the vicinity of the external surface of the core particles where to the polymerizable monomer for the shell has migrated, and the polymer (shell) is easily formed on the surfaces of the core particles.

Examples of water-soluble radical initiators include persulfates such as potassium persulfate and ammonium persulfate; azo initiators such as 4,4'-azobis (4-cyanovaleric acid), 2,2'-azobis (2-amidinopropane) dihydrochloride and 2,2'-azobis-2-methyl-N-1,1'-bis (hydroxymethyl)-2-hydroxyethyl propioamide; and the combination of oil-soluble initiators such as cumene peroxide and a redox catalyst. The water-soluble radical initiator is generally used at 1 to 50% by weight, preferably 2 to 20% by weight per 100 parts by weight of the monomer for the shell.

The polymerizable monomer for the core and the polymerizable monomer for the shell are used generally in the weight ratio of 80/20 to 99.9/0.1.

If the proportion of the monomer for the shell is excessively small, the effect for improving shelf stability may lower; on the other hand, if the proportion of the monomer for the shell is excessively large, the effect for lowering the fixing temperature may lower.

EXAMPLES

The present invention will be described below more specifically referring to examples and comparative examples; however, the present invention is by no means limited to these examples. Unless otherwise specified, parts and percentages are expressed by weight.

The examples were evaluated using the following methods:

1. Toner properties (Volume Average Particle Diameter and Particle Diameter Distribution)

The volume average particle diameter (dv) and the particle diameter distribution of the toner, that is the ratio (dv/dp) of the volume average particle diameter to the number average particle diameter (dp) of the toner was measured by a Multisizer (manufactured by Beckman Coulter Co.). The measurement by the Multisizer was conducted under the conditions of: aperture diameter: 100 μm; medium: Isothone II; concentration: 10%; and the number of particles measured: 100,000 particles.

(Quantities of Thiazolyl Disulfide Compound or Thiuramdisulfide Compound)

In order to measure the content of these compounds, about 10 g of accurately weighed toner was dissolved in tetrahydrofuran, and added to methanol to reprecipitate the polymer. The filtrate after filtering and removing the polymer was concentrated, and was measured with an apparatus where to a mass spectrometer and a liquid chromatograph are connected using chloroform as the eluent.

(Molecular Weight)

In 10 ml of tetrahydrofuran, 0.1 g of the toner was dissolved, filtered with a membrane filter, and the molecular weight of the THF-soluble matter in the filtrate was obtained as the molecular weight converted to polystyrene using a gel permeation chromatography apparatus (manufactured by Tosoh Corporation, model GPC8220).

(Melting Properties)

In an elevated flow tester (manufactured by Shimadzu Corporation, model CFT-500C), 1 to 1.3 g of the toner is placed, and the softening point (Ts) and the flow-starting temperature (TFb) were measured under the following conditions. The smaller the difference between the softening point and the flow-starting temperature, the larger the sharp-melt property of the toner.

Temperature at the start of measurement: 35° C.
Temperature raising speed: 3° C./min
Preheating time: 5 minutes
Cylinder pressure: 10 kg.f/cm$^2$
Die diameter: 0.5 mm
Die length: 1.0 mm
Shear stress: $2.451\times10^5$ Pa (Shelf Stability)

For the evaluation of shelf stability, the toner was placed in a closed container, and the container was sunk into a constant-temperature water bath controlled to 50° C. The container was taken out of the constant-temperature water bath after 30 days had elapsed, and the toner contained in the container was transferred to a 42-mesh screen so as not to destroy the aggregate structure of the toner. The screen was vibrated using a powder measuring apparatus ("Powder Tester", trade name, manufactured by Hosokawa Micron Corporation) whose vibration intensity was set at 4.5 for 30 seconds, and the weight of the toner remaining on the screen was measured to regard it as the weight of the aggregated toner. The shelf stability of the toner (% by weight) was calculated from the weight of the aggregated toner and the weight of the sample.

2. Image Quality (Fixing Temperature)

The fixing test was conducted using a commercially available color printer of a non-magnetic one-component developing system (manufactured by Oki Data Corporation, model "Microline 3020C") modified so as to be able to vary the temperature of the fixing roll unit. In the fixing test, the temperature of the fixing roll of the modified printer is varied, and the fixing degree of the developer was measured at each temperature to obtain temperature-fixing degree relationship.

The fixing degree was calculated from the ratio of image densities before and after the tape pealing operation in the solid black area printed on a test paper sheet using the modified printer allowed to stand for 5 minutes or more to stabilize the temperature of the fixing roll when the temperature was varied. Specifically, the fixing degree is calculated from the image density before tape peeling, $ID_{before}$, and the image density after tape peeling, $ID_{after}$, using the following equation:

$$\text{Fixing degree (\%)}=(ID_{after}/ID_{before})\times100$$

Here, the tape peeling operation means a series of operations wherein an adhesive tape (Scotch Mending Tape 810-3-18, manufactured by Sumitomo 3M Limited) is adhered to the portion of the paper sheet to be measured, compressed under a constant pressure, and thereafter the adhesive tape is peeled in the direction along the paper at a constant speed. The image density was measured by means of an image densitometer manufactured by McBeth Co.

In this fixing test, a temperature of the fixing roll at which a fixing degree amounted to 80% was defined as a fixing temperature of the developer.

(Hot Offset Temperature)

Black solid printing was conducted by varying fixing temperatures in the same manner as in the fixing temperature test, and the temperature when the hot off set occurred wad defined as the hot offset temperature.

Example 1

An evenly mixed liquid was obtained by dispersing 90 parts of styrene, 10 parts of n-butyl acrylate, 5 parts of Pigment Red 122, 1 part of a negative charge control resin (trade name "FCA626N", manufactured by Fujikura Kasei Co., Ltd. (sulfonate group containing monomer content: 7%) weight average molecular weight: 26,800; glass transition temperature: 58° C.) and 10 parts of dipentaerythritol hexamyristate in a beads mill at room temperature. Thereafter, 1 part of 2,2,4,6,6-pentamethylheptane-4-thiol and 1 part of tetraethylthiuram disulfide were added to form a polymerizable monomer composition for the core.

On the other hand, an aqueous solution prepared by dissolving 6.9 parts of sodium hydroxide in 50 parts of ion-exchanged water is gradually added to an aqueous solution prepared by dissolving 9.8parts of magnesium chloride (water-solublemultivalentmetal salt) in 250 parts of ion-exchanged water under stirring to prepare a magnesium hydroxide colloid dispersion liquid. The above-described monomer composition and 5 parts of t-butyl peroxy-2-ethylhexanoate, which is a polymerization initiator, is poured into the magnesium hydroxide colloid dispersion liquid obtained as described above, stirred and mixed using a propeller stirrer to obtain a composition dispersion liquid, then, supplied to the dispersing machine (trade name "Clearmix CLM-0.8S", manufactured by M-Technique Co., Ltd.) operated at a rotor rotating speed of 21,000 rpm using a pump to form the droplets of the monomer composition for the toner. The aqueous dispersion liquid of the monomer composition was transferred to a reactor equipped with stirring blades. The aqueous dispersion liquid of the composition was heated to initiate polymerization. At this time, the jacket temperature of the polymerization reactor and the temperature in the polymerization reactor were measured so that the temperature of the aqueous dispersion liquid became constant at 90° C., and the jacket temperature was controlled using a cascade control method or the like.

The polymerization conversion reaching almost 100% was confirmed, 2 parts of methyl methacrylate was added, and further an initiator solution prepared by dissolving 0.2 part of 2,2'-azobis [2-methyl-N-(2-hydroxyethyl)-propionamide] ("VA-086", trade name; product of Wako Pure Chemical Industries, Ltd.) in 100 parts of ion-exchanged water, and polymerized to obtain the aqueous dispersion of polymer particles. The aqueous polymer particles were dehydrated, washed and dried to obtain the toner particles of a core-shell structure.

The properties of the obtained toner are shown in Table 1.

To 100 parts of the toner particles obtained as described above, 0.6 part of hydrophobic treated colloidal silica ("RX-300", trade name; product of Nippon Aerosil Co., Ltd.) was added, mixed using a Henschel mixer to produce a toner. The volume resistivity of the toner was 11.4 (log (Ω·cm)). The volume average particle diameter (dv) of the toner was 6.9 μm, and the volume average particle diameter (dv)/number average particle diameter (dp) ratio was 1.27.

The image quality of the obtained toner was evaluated. The results are shown in Table 1.

Examples 2 to 6 and Comparative Examples 1 to 3

Toners were obtained in the same manner as in Example 1, except that materials used in Example 1 other than styrene and n-butyl acrylate were changed as Table 1 shows to prepare polymerizable monomer composition for the core.

Here, in Example 3, FCA207P (quaternary ammonium base containing monomer content: 2.3%) of a weight average molecular weight of 11,900, and a glass transition temperature of 62° C. produced by Fujikura Kasei Co., Ltd. was used as the positive charge control resin; and 0.6 part of "HDK2150" produced by Nippon Aerosil Co. ,Ltd. was used in place of 0.6 part of "RX-300" produced by Nippon Aerosil Co., Ltd. As a commercially available color printer for evaluating image quality, "HL1670N" manufactured by Brother Industries Ltd. was used.

The properties and image qualities of obtained toners were evaluated. The results are shown in Table 1.

The results of the evaluation of the toners in Table 1 showed the following:

With color toners of Comparative Examples 1 and 2 containing neither a thiazolyl disulfide compound nor a thiuram disulfide compound in the toners, the sharpness of melting is low, the fixing temperature is high and shelf stability is low.

With the black toner of Comparative Example 3 containing neither a thiazolyl disulfide compound nor a thiuram disulfide compound in the toners, the fixing temperature is high and shelf stability is low.

Whereas with the color toners of Examples 1 to 5 of the present invention, the sharpness of melting is high, the fixing temperature is low and shelf stability is high. With the black toner of Example 6, the fixing temperature is low and shelf stability is high.

INDUSTRIAL APPLICABILITY

According to the present invention, there are provided a toner having a low fixing temperature, and enabling high-speed image formation; and a process for producing such a toner.

Also according to the present invention, there are provided a toner that can form clear images even used for a long period, because the balance of fixing properties and storage properties is excellent; and a process for stably producing such a toner.

Furthermore, according to the present invention, there are provided a toner that excels in sharp-melt properties required for reproducing clear color tones of color images especially when applied to a color toner; and a process for producing such a toner.

The invention claimed is:

1. A toner containing a binder resin, a colorant, a charge control agent, and a thiazolyl disulfide compound selected from the group consisting of dibenzothiazyl disulfide, 2-(4'-morpholinodithio) benzothiazole, 1,1'-bis(2-benzothiazolylthio)methane and 1,2'-bis(2-benzothiazolylthio)ethane or a thiuram disulfide compound selected from the group consisting of tetramethyl thiuram disulfide, tetraethyl thiuram disulfide, tetrabutyl thiuram disulfide, dipentamethylene thiuram tetrasulfide, N,N'-dimethyl-N,N'-diphenyl thiuram disulfide and N,N'-dioctadecyl-N,N'-diisopropyl thiuram disulfide, wherein the content of the thiazolyl dis-

TABLE 1

| | Example | | | | | | Comparative Example | | |
|---|---|---|---|---|---|---|---|---|---|
| | 1 | 2 | 3 | 4 | 5 | 6 | 1 | 2 | 3 |
| Quantity of specific compound (ppm) *1 | 42 | 85 | 30 | 25 | 92 | 78 | 0 | 0 | 0 |
| Tetraethyl thiuram disulfide | 1 | 2 | 1 | — | — | 2 | — | — | — |
| 2-(4'-Morpholidithio)-benzothiazole | — | — | — | 1 | — | — | — | — | — |
| Zinc N-ethyl-N-phenyl dithiocarbamate | — | — | — | — | 1 | — | — | — | — |
| 2,2,4,6,6-Pentamethylheptane-4-thiol | 1 | — | 1 | 1 | 1 | — | 3 | 2 | 2 |
| Divinyl benzene | — | — | — | — | — | 1 | — | — | 0.5 |
| Negative charge control resin | 1 | 1 | — | 1 | 1 | 1 | 1 | — | 1 |
| Positive charge control resin | — | — | 1 | — | — | — | — | 1 | — |
| Carbon black | — | — | — | — | — | 7 | — | — | 7 |
| Pigment Red 122 | 5 | — | 5 | 5 | 5 | — | 5 | 5 | — |
| Pigment Yellow 180 | — | 5 | — | — | — | — | — | — | — |
| Mn | 5,300 | 4,800 | 5,900 | 5,500 | 8,500 | 6,800 | 3,500 | 9,800 | 10,500 |
| Mw | 10,200 | 8,100 | 11,000 | 10,000 | 19,500 | 35,400 | 8,900 | 38,000 | 45,000 |
| Mw/Mn | 1.92 | 1.69 | 1.86 | 1.82 | 2.29 | 5.21 | 2.54 | 3.88 | 4.29 |
| Ts (° C.) | 69 | 67 | 67 | 70 | 68 | 69 | 68 | 75 | 69 |
| Tfb (° C.) | 80 | 77 | 76 | 80 | 88 | 125 | 91 | 115 | 102 |
| Tfb-Ts (° C.) | 11 | 10 | 9 | 10 | 20 | 56 | 23 | 40 | 33 |
| Shelf stability (%) | 0.3 | 0.4 | 0.4 | 0.4 | 0.3 | 0.3 | 85 | 12 | 10 |
| Fixing temperature (° C.) | 135 | 130 | 130 | 130 | 140 | 130 | 165 | 180 | 185 |
| Hot offset temperature (° C.) | 210 | 200 | 220 | 220 | 220 | 220 | 220 | 220 | 220 |

*1: Quantity of thiazolyl disulfide compound or thiuram disulfide compound ulfide compound or the thiuram disulfide compound is 10 to 5,000 ppm, and the volume average particle diameter of said toner is 2 to 10 μm.

2. The toner according to claim 1, wherein the charge control agent is a charge control resin.

3. The toner according to claim 2, wherein the glass transition temperature of the charge control resin is 40 to 80° C.

4. The toner according to claim 1, wherein said toner further contains a parting agent.

5. The toner according to claim 4, wherein the parting agent is a multifunctional ester compound.

6. The toner according to claim 5, wherein the multifunctional ester compound is a dipentaerythritol ester of which the greatest heat absorption occurs at a temperature from 50 to 80° C.

7. The toner according to claim 1, wherein said toner is a toner of a core-shell structure obtained by coating core particles comprising a binder resin, a colorant, a charge control agent, and a thiazolyl disulfide compound or a thiuram disulfide compound and having a volume average particle diameter of 2 to 10 μm with a shell composed of a polymer layer.

8. A process for producing a toner having a volume average particle diameter of 2 to 10μmm comprising polymerization of a polymerizable monomer composition which contains a polymerizable monomer, a colorant, a charge control agent and 0.01 to 10 parts by weight, per 100 parts by weight of the polymerizable monomer, of at least one compound A selected from the group consisting of (1) a thiazol thio compound, (2) a thiuram compound and (3) a dithiocarbamate compound using an oil-soluble polymerization initiator selected from the group consisting of a peroxysulfate, an azo compound, an peroxide and a redox initiator in an aqueous dispersing medium containing a dispersion stabilizer.

9. The process for producing the toner according to claim 8, wherein the polymerization is suspension polymerization.

10. A process for producing a toner having a volume average particle diameter of 2 to 10μm, comprising polymerization of a polymerizable monomer composition which contains 100 parts by weight of a polymerizable monomer, 1 to 10 parts by weight of a colorant, 0.01 to 20 parts by weight of a charge control agent, and 0.01 to 10 parts by weight of compound A selected from the group consisting of (1) a thiazol thio compound, (2) a thiuram compound and (3) a dithiocarbamate compound using an oil-soluble polymerization initiator selected from the group consisting of a peroxysulfate, an azo compound, an peroxide and a redox initiator in an aqueous dispersing medium containing a dispersion stabilizer.

11. The process for producing the toner according to claim 10, wherein the polymerization is suspension polymerization.

12. A process for producing a toner of a core-shell structure comprising steps of: producing core particles having a volume average particle diameter of 2 to 10μm, by suspending a polymerizable monomer composition for the core which contains a polymerizable monomer, a colorant, a charge control agent, and 0.01 to 10 parts by weight, per 100 parts by weight of the polymerizable monomer, of at least one compound A selected from a the group consisting of (1) a thiazol thio compound, (2) a thiuram compound and (3) a dithiocarbamate compound in an aqueous dispersing medium containing a dispersion stabilizer and then polymerizing said monomer composition using an oil-soluble polymerization initiator selected from the group consisting of a peroxysulfate, an azo compound, an peroxide and a redox initiator; and further adding a polymerizable monomer for the shell and a water-soluble radical polymerization initiator to polymerize said monomer.

* * * * *